US007430153B2

(12) United States Patent
Fraser et al.

(10) Patent No.: US 7,430,153 B2
(45) Date of Patent: Sep. 30, 2008

(54) DOWNHOLE TOOL AND METHOD

(75) Inventors: Simon Benedict Fraser, Aberdeen (GB); William Brown-Kerr, Aboyne (GB); John Knight, Banchory (GB)

(73) Assignee: Maxwell Downhole Technology Ltd. (GB)

( * ) Notice: Subject to any disclaimer, the term of this patent is extended or adjusted under 35 U.S.C. 154(b) by 221 days.

(21) Appl. No.: 10/929,345

(22) Filed: Aug. 26, 2004

(65) Prior Publication Data

US 2005/0045344 A1 Mar. 3, 2005

(30) Foreign Application Priority Data

Sep. 1, 2003 (GB) ..... 0320357.7

(51) Int. Cl.
*E21B 47/18* (2006.01)

(52) U.S. Cl. ..... 367/85; 367/83; 166/386

(58) Field of Classification Search ..... 367/83–85; 166/386

See application file for complete search history.

(56) References Cited

U.S. PATENT DOCUMENTS 3,958,217 A 5/1976 Spinnler
4,742,498 A 5/1988 Barron
5,473,579 A 12/1995 Jeter
6,125,933 A * 10/2000 Ross ..... 166/250.01

FOREIGN PATENT DOCUMENTS

GB 2 083 104 7/1981

* cited by examiner

*Primary Examiner*—Giovanna C Wright
(74) *Attorney, Agent, or Firm*—Stephen M. Nipper; Dykas, Shaver & Nipper, LLP

(57) ABSTRACT

A downhole tool for generating a fluid pressure pulse, and to a method of generating a fluid pressure pulse downhole. One example being, an improved downhole tool and method for transmitting data signals from a downhole environment to surface, the downhole tool comprising a fluid actuated flow restrictor; a first fluid flow path for flow of actuating fluid to actuate the flow restrictor; a second fluid flow path for flow of actuating fluid to actuate the flow restrictor; and a control member movable between a first closed position where the first fluid flow path is closed and the second fluid flow path is open, and a discrete second closed position where the first fluid flow path is open and the second fluid flow path is closed, for controlling actuation of the flow restrictor to generate a fluid pressure pulse.

44 Claims, 2 Drawing Sheets

DOWNHOLE TOOL AND METHOD

PRIORITY

This application claims the priority date of the foreign application entitled Downhole Tool and Method filed by Maxwell Downhole Technology Limited on Sep. 1, 2003 with serial number GB 0320357.7.

FIELD OF THE INVENTION

The present invention relates to a downhole tool for generating a fluid pressure pulse, and to a method of generating a fluid pressure pulse downhole. In particular, but not exclusively, the present invention relates to an improved downhole tool and method for transmitting data signals from a downhole environment to surface.

BACKGROUND OF THE INVENTION

In the oil and gas exploration and production industry, it is known to measure parameters of a well and to transmit information relating to the measured parameters to surface. These parameters may include, for example, inclination or azimuth of a well borehole, drilling fluid flow rates, temperature, data relating to geological conditions of surrounding rock strata and the like.

One way in which this is currently achieved is through mud pulse telemetry. This involves measuring a desired downhole parameter and transmitting data relating to the measured parameter to surface, by generating corresponding fluid pressure pulses in a column of fluid in the well borehole. These pressure pulses are detected at surface and analysed to determine the value of the measured parameter. Measurement and transmission of such data may be carried out during a drilling procedure, and is known in the industry as measurement whilst drilling (MWD), or logging whilst drilling (LWD). Devices of this type are disclosed, for example, in U.S. Pat. No. 3,958,217 assigned to Teleco Inc. and U.S. Pat. No. 4,742,498 assigned to Eastman Chistensen Company.

In currently known devices, such as those of U.S. Pat. Nos. 3,958,217 and 4,742,498, a main, fluid actuated valve is used to create a restriction in a well borehole to generate a pulse. A servo valve is movable between open and closed positions to control fluid flow to the main valve, to thereby control movement of the main valve and thus generation of the pulse. A flow path exists through a mechanism of the servo valve such that there is a continuous fluid flow through or past the servo valve either during operation of the servo valve to generate a pulse, as in U.S. Pat. No. 4,742,498, or prior to operation of the servo valve to generate a pulse, as in U.S. Pat. No. 3,958,217.

This flow path is part of a pressure-balancing system necessary for correct operation of the servo valve and includes relatively fine passageways. These passages are prone to blockage by solid particulates and other solids commonly present downhole, such as those sometimes found in drilling mud. Also, the flow of high pressure, relatively abrasive fluids, such as drilling mud tends to cause wear/erosion of components of the known devices, particularly the servo valve, which require regular maintenance and replacement of worn components to ensure continued operation.

SUMMARY OF THE INVENTION

It is amongst the objects of embodiments of the present invention to obviate or mitigate at least one of the foregoing disadvantages.

According to a first aspect of the present invention, there is provided a downhole tool for generating a fluid pressure pulse, the tool comprising:

- a fluid actuated flow restrictor;
- a first fluid flow path for flow of actuating fluid to actuate the flow restrictor;
- a second fluid flow path for flow of actuating fluid to actuate the flow restrictor; and
- a control member movable between a first closed position where the first fluid flow path is closed and the second fluid flow path is open, and a discrete second closed position where the first fluid flow path is open and the second fluid flow path is closed, for controlling actuation of the flow restrictor.

Thus movement of the control member between the closed positions controls fluid flow to and from the flow restrictor, thereby controlling generation of a fluid pressure pulse. Accordingly, by locating the tool in a downhole environment, such as in a well borehole, the tool can be used to generate fluid pressure pulses to transmit data concerning measured downhole parameters to surface.

Preferably, the first fluid flow path is for flow of actuating fluid to the flow restrictor and the second fluid flow path is for flow of actuating fluid from the flow restrictor. Accordingly, the control member may serve for controlling flow of actuating fluid to directly actuate the flow restrictor. Alternatively, the tool may further comprise an intermediate member and the first fluid flow path may be for fluid flow to the intermediate member and the second fluid flow path for fluid flow from the intermediate member. Thus the control member may serve for controlling fluid flow to and from the intermediate member, which may in turn control actuation of the flow restrictor, for example, by fluid communication with the flow restrictor. This may allow isolation of at least part of the flow restrictor from the actuating fluid and said part may therefore be actuatable, for example, using a dedicated control fluid such as a hydraulic fluid. The intermediate member may comprise a piston mounted in a cylinder.

Preferably, during movement of the control member between the first and second closed positions, both the first and second fluid flow paths are open. The control member may be adapted to be moved between said closed positions in a determined time period, which may be of the order of fractions of a second. Accordingly, the time period during which both the first and second fluid flow paths are both open may be minimised.

By providing a control member which is movable between closed positions in this fashion, the tool can be arranged such that there is a limited flow of fluid past or through the control member before, during and after generation of a pulse. Accordingly, the tool may be arranged to allow flow of a determined volume of fluid to or from the flow restrictor through the first and second flow paths. This may be achieved by providing the flow restrictor with a fluid actuated member mounted in a cylinder or the like, and supplying fluid to and from the cylinder under the control of the control member. The volume of fluid flow past or through the control member may be greatly reduced when compared to prior proposals, reducing wear on the control member (due in particular to flow of high pressure, relatively abrasive fluids, such as drilling mud) and reducing the likelihood of blockage. The first and second fluid flow paths may be closed or dead-ended; in this fashion, there may be a limited fluid flow through or past the control member in operation.

It will be understood that the first and second closed positions of the control member are discrete in that the closed positions are separate and spaced apart.

The control member may be movable in response to an applied actuating force.

The tool may be arranged such that when the control member is in the first closed position, part of the flow restrictor is exposed to fluid at a downstream fluid pressure, and when in the second closed position, said part of the flow restrictor is exposed to fluid at an upstream fluid pressure. This may facilitate movement of the flow restrictor. It will be understood that references herein to upstream and downstream locations are made relative to the tool when in a fluid flow environment.

The first closed position of the control member may be a de-energised closed position, and the second closed position may be an energised closed position, movement from the de-energised closed position to the energised closed position to cause generation of a fluid pressure pulse. Alternatively or additionally, movement of the control member from the energised closed position to the de-energised closed position may be adapted to generate a fluid pressure pulse.

The control member may be biased towards a selected closed position. The control member may be spring biased, or may be biased by applied fluid pressure. Thus in the absence of an applied actuating force exerted on the control member, the control member may be biased towards the selected closed position, which is preferably a de-energised closed position where the first fluid flow path is closed.

The control member may take the form of or may comprise a control valve, and the tool may further comprise a control valve seat, the control valve adapted to sealingly engage or abut said valve seat when in a selected closed position. Preferably, the tool comprises a plurality of valve seats, one corresponding to each of said first and second closed positions of the control valve.

Preferably, the first and second fluid flow paths are internal and defined by a body of the tool. The flow paths may extend between part of the flow restrictor and an exterior of the tool, and the tool may be actuatable using downhole fluid, such as a drilling fluid. Thus the pressure of the fluid in the downhole environment may be utilised to actuate the tool. Alternatively, the flow paths may extend between part of the flow restrictor and a source of actuating fluid. Accordingly, the tool may be actuatable using a dedicated control fluid, such as a hydraulic fluid, and the tool may further comprise control lines, supply conduits or the like for coupling the tool to a source of control fluid.

One of the first and second fluid flow paths may comprise an inlet and the other an outlet/exhaust, facilitating selective fluid flow to and from part of the flow restrictor. The first fluid flow path may comprise the inlet and the second fluid flow path the outlet, facilitating fluid flow from the inlet to the flow restrictor through the first flow path, and from the flow restrictor to the outlet through the second flow path.

Preferably, at least part of the flow restrictor is movable to generate a fluid pressure pulse and said part may be movable between a de-energised position, and an energised position where fluid flow is restricted compared to the de-energised position. The tool may be arranged to generate a positive fluid pressure pulse (an increase in fluid pressure detected at surface) by movement of said part from the de-energised to the energised position, and/or to generate a negative fluid pressure pulse (a decrease in fluid pressure detected at surface) by movement of said part from the energised to the de-energised position.

The flow restrictor may take the form of a main valve, and a body of the main valve may be moveable between de-energised and energised positions, to generate a fluid pressure pulse.

The flow restrictor may comprise a piston, which may form the fluid actuated member. Preferably, the piston is coupled to the valve body, and may be movable to thereby move the valve body and generate a pulse. The piston may be movable on selective exposure to fluid pressure, controlled by the control member. The piston may comprise a piston face, and when the control member is in the first closed position, said piston face may be exposed to fluid at a downstream fluid pressure, and when in the second closed position, said piston face may be exposed to fluid at an upstream fluid pressure.

The tool may further comprise an actuating assembly, of which the control member may form part, and part of the actuating assembly may serve for moving the control member between said closed positions. The actuating assembly may be electromechanical, mechanical, electronic or fluid operated. The actuating assembly may comprise a solenoid having a solenoid rod and a solenoid coil for exerting an actuating force on the rod, and the control member may comprise or form the solenoid rod. Alternatively, the actuating assembly may comprise a motor or the like adapted to exert a drive force on the control member, which may be coupled to the motor through a drive rod, shaft, screw or the like. In a further alternative, where the actuating assembly is fluid operated, the assembly may comprise a piston. Thus by controlling fluid supply to the piston, movement of the control member can be controlled.

The tool may further comprise an outer mounting which, together with the flow restrictor, may define an external fluid flow channel. The flow restrictor may be movable relative to the outer mounting to restrict the external fluid flow channel and generate a fluid pressure pulse. The tool may comprise a tool body housing the flow restrictor and the control member, and the tool body may be adapted to be mounted in the outer mounting. The outer mounting may be adapted to locate the tool downhole, such as in a downhole tubing in a borehole.

At least part of the control member may be mounted in a chamber isolated from external fluid. This may prevent contamination by solids present in drilling fluid, or by other fluids or solids found downhole. A lubricating fluid may be provided in the chamber, and the tool may include a pressure compensator, which may take the form of a balancing piston, for pressurising the lubricating fluid to a pressure of fluid in the borehole. This may prevent hydraulic lock of the control member and may allow movement of the control member between said closed positions.

The control member may be repeatedly movable between the first and second closed positions, for generating a plurality of fluid pressure pulses.

The tool may take the form of a MWD or LWD tool and may comprise at least one, preferably a plurality of sensors for measuring at least one downhole parameter or parameters.

According to a second aspect of the present invention, there is provided a downhole tool comprising:

- a fluid actuated flow restrictor;
- a first fluid flow path for communicating a first actuating pressure to the flow restrictor;
- a second fluid flow path for communicating a second actuating pressure to the flow restrictor; and
- a control member movable between a first closed position where the first fluid flow path is closed and the second fluid flow path is open, and a discrete second closed position where the first fluid flow path is open and the second fluid flow path is closed, for controlling actuation of the flow restrictor.

According to a third aspect of the present invention, there is provided a downhole tool comprising:

a fluid actuated flow restrictor movable to generate a fluid pressure pulse; and a control member operatively associated with the flow restrictor and movable between a de-energised closed position and an energised closed position, to control fluid flow to actuate the flow restrictor and thus generate a fluid pressure pulse.

According to a fourth aspect of the present invention, there is provided a downhole tool for generating a fluid pressure pulse, the tool comprising:

a fluid actuated flow restrictor;

a first fluid flow path for flow of actuating fluid to the flow restrictor;

a second fluid flow path for flow of actuating fluid from the flow restrictor; and a control member movable between a first closed position where the first fluid flow path is closed and the second fluid flow path is open, and a discrete second closed position where the first fluid flow path is open and the second fluid flow path is closed, for controlling actuation of the flow restrictor.

According to a fifth aspect of the present invention, there is provided a method of generating a fluid pressure pulse downhole, the method comprising the steps of:

locating a fluid actuated flow restrictor downhole;

providing a first fluid flow path for flow of actuating fluid to actuate flow restrictor;

providing a second fluid flow path for flow of actuating fluid to actuate the flow restrictor; and moving a control member between a first closed position where the first fluid flow path is closed and the second fluid flow path is open and a discrete second closed position where the first fluid flow path is open and the second fluid flow path is closed, to actuate the flow restrictor and generate a fluid pressure pulse.

The method may be a method of transmitting data to surface, which may relate to at least one measured downhole parameter, by generation of a fluid pressure pulse, and thus the pulse may correspond to the measured parameter. Preferably, the method is a MWD or LWD method.

The method may be a method of generating a positive fluid pressure pulse and may comprise moving the control member from the first closed position to the second closed position to generate the positive pulse. Alternatively, the method may be a method of generating a negative fluid pressure pulse and may comprise moving the control member from the second closed position to the first closed position to generate the negative pulse.

The method may comprise exerting an actuating force on the control member to move the member between the first and second closed positions and thus control generation of the pulse.

The flow restrictor may be moved between a de-energised position and an energised position, where fluid flow is restricted compared to the de-energised position, for generating the pulse, or vice-versa.

The method may comprise opening both fluid flow paths during transition of the control member between the first and second closed positions, which may facilitate the desired flow of fluid to/from the control member.

BRIEF DESCRIPTION OF THE DRAWINGS

An embodiment of the present invention will now be described, by way of example only, with reference to the accompanying drawings in which.

DETAILED DESCRIPTION OF THE DRAWINGS

Figure 1:
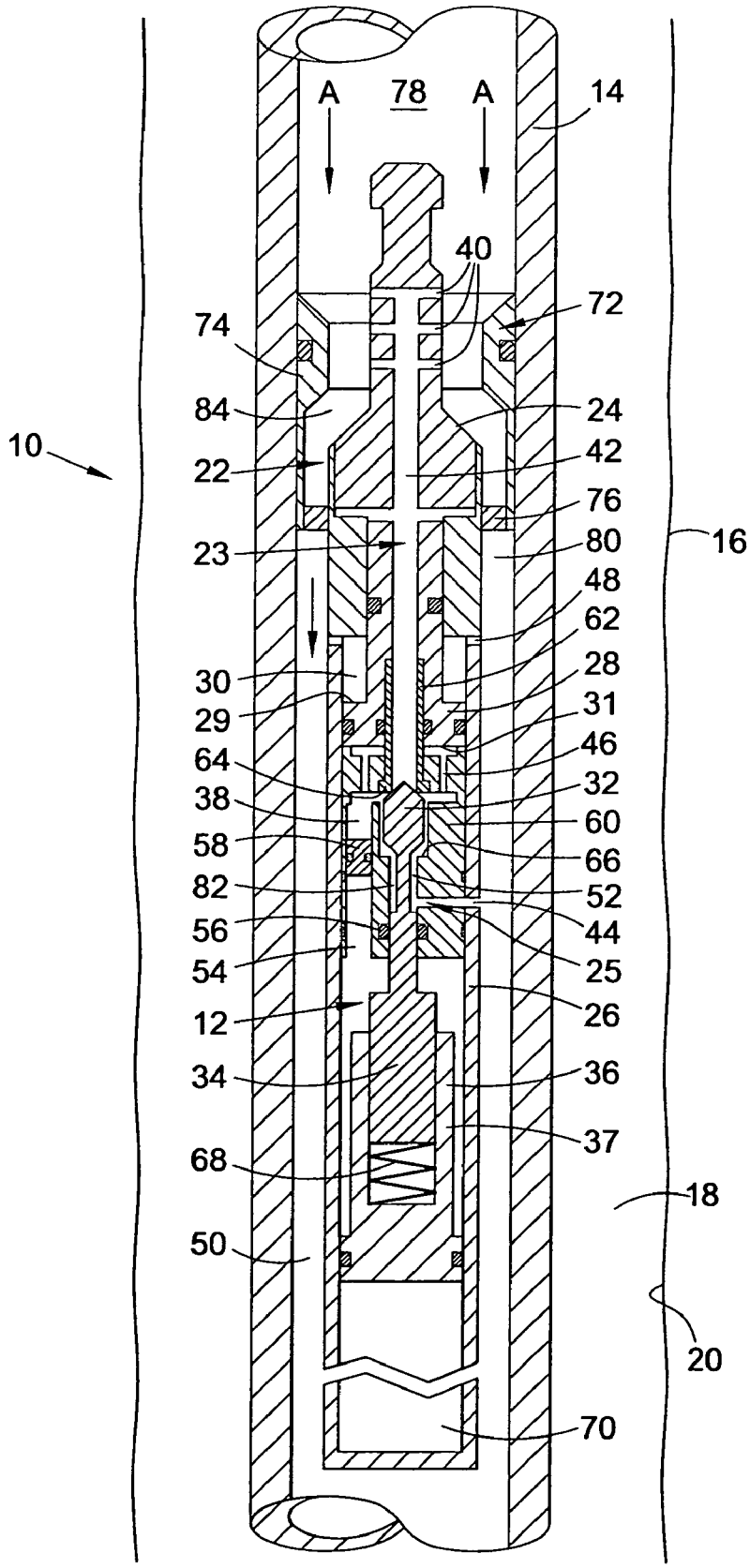
FIG. 1 is a longitudinal sectional view of a downhole tool for generating a fluid pressure pulse in accordance with a preferred embodiment of the present invention, with a control member of the tool shown in a first closed position.

Referring firstly to FIG. 1, there is shown a longitudinal sectional view of a downhole tool for generating a fluid pressure pulse, the tool indicated generally by reference numeral 10, and shown in FIG. 1 with a control member 12 of the tool in a first, de-energised closed position. As will be described in more detail below, the tool 10 is utilised to generate fluid pressure pulses indicative of parameters measured in a downhole environment.

The tool 10 is shown in FIG. 1 located within a well bore tubular such as a drill string 14, and takes the form of a measurement whilst drilling (MWD) or logging whilst drilling (LWD) tool. The drill string 14 includes a drill bit (not shown) at a lower end, and is shown during drilling of a borehole 16. In a conventional fashion, the drilling procedure involves pumping a drilling fluid down through the drill string 14 in the direction of the arrows A to drive a drilling motor (not shown) coupled to the drill bit, the drilling fluid exiting the drill bit and returning to surface through an annulus 18 between a wall 20 of the borehole 16 and the drill string 14. Alternatively, the drill string 14 may be rotated from surface to drive the drill bit.

Figure 2:
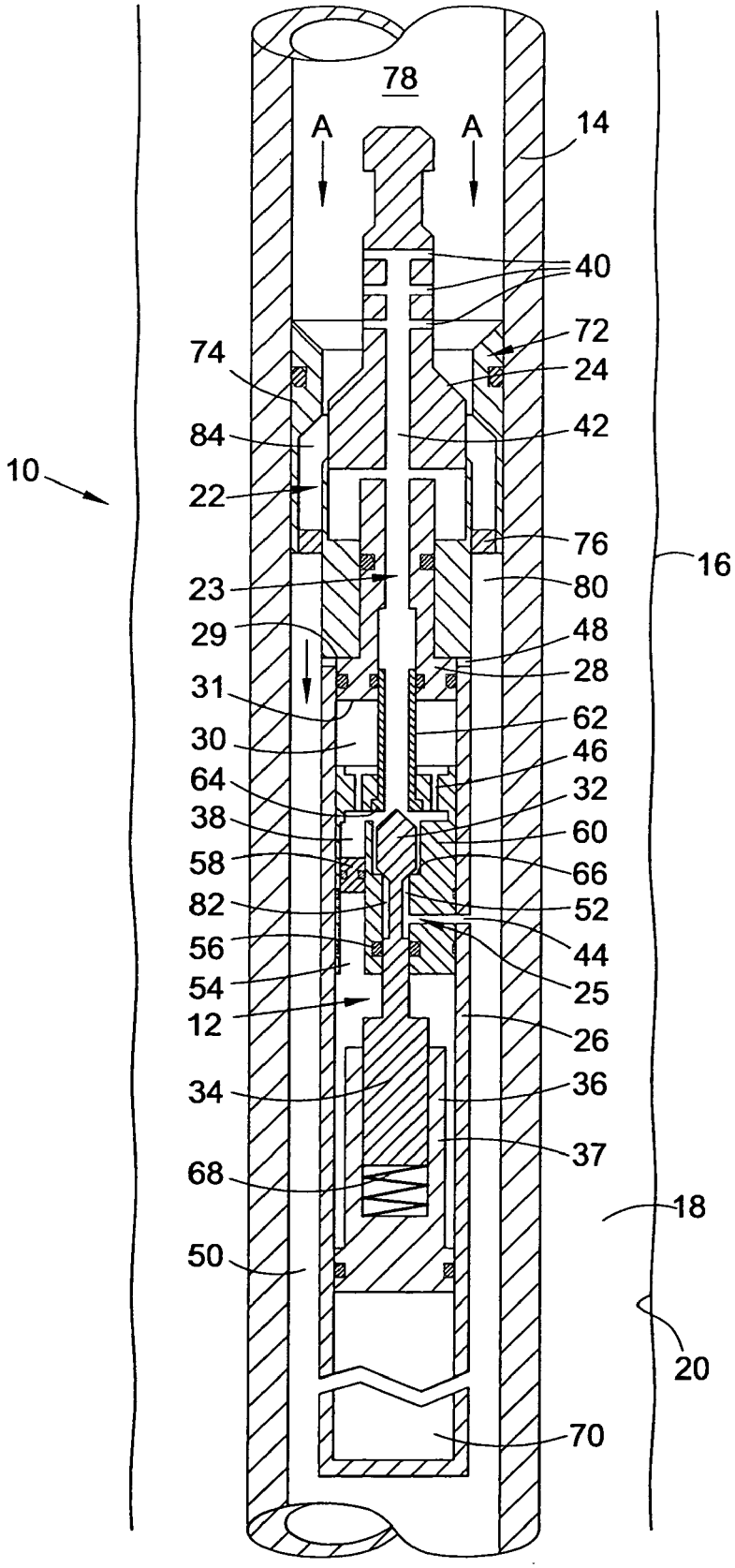
FIG. 2 is a view of the downhole tool of FIG. 1 showing the control member following movement to a discrete, second closed position.

The tool 10 generally comprises a fluid actuated flow restrictor 22, control member 12, a first fluid flow path 23 for flow of actuating fluid to actuate the flow restrictor 22, and a second fluid flow path 25 for flow of actuating fluid to actuate the flow restrictor 22. The control member 12 serves for controlling actuation of the flow restrictor 22, and is locatable in one of at least two discrete closed positions. As discussed above, the control member 12 is shown in FIG. 1 in a first, de-energised closed position. In this first closed position, the first fluid flow path 23 is closed and the second fluid flow path 25 is open. FIG. 2 shows the control member 12 following movement to a second, energised closed position where the first fluid flow path 23 is open and the second fluid flow path 25 is closed.

In the preferred embodiment shown, movement of the control member 12 from the first closed position (FIG. 1) to the second closed position (FIG. 2) supplies fluid to the flow restrictor 22, to urge the flow restrictor 22 from a de-energised position shown in FIG. 1, to an energised position shown in FIG. 2. In the energised position, the flow restrictor 22 restricts flow of fluid through the drill string 14 relative to the de-energised position of FIG. 1, generating a fluid pressure pulse. Accordingly, generation of fluid pressure pulses is controlled by the control member 12, and this may be utilised to send data to surface relating to measured downhole parameters.

The downhole tool 10 and its method of operation will now be described in more detail.

The flow restrictor 22 takes the form of a main valve, and includes a main valve body 24 which is mounted within a housing 26 of the tool 10 for movement between de-energised and energised positions. The main valve body 24 also defines a fluid actuated member in the form of a main valve piston 28, which is mounted within a cylinder 30 defined by the tool housing 26.

The control member 12 takes the form of a servo valve which includes a servo poppet 32 at an upper end thereof. The control member 12 forms part of an actuating assembly 36, and a lower shaft 34 of the servo valve 12 is mounted in an actuator 37, by which an actuating force is exerted on the poppet 32 to move the poppet between the first and second closed positions. In the illustrated embodiment, the actuating assembly 26 comprises a solenoid, where the actuator 37 is a solenoid coil and the servo valve lower shaft 34 takes the form of a solenoid rod.

The fluid flow path 23 includes a number of fluid inlets 40 which are formed in the main valve body 24, and a passage 42 which extends through the valve body 24 and an interior of the piston 28. The second fluid flow path 25 includes an outlet or exhaust 44, and extends through an area 82 around an upper servo valve shaft 52. A number of passageways 46 are provided for selectively directing fluid from the inlets 40 into the cylinder 30, or from the cylinder 30 to the outlet 44. The cylinder 30 also includes a number of ports 48, which open onto an annulus 50 defined between the drill string 14 and the tool housing 26.

The lower shaft 34 of the servo valve 12 and the solenoid coil 37 are mounted in a lubricating fluid chamber 54, which is filled, for example, with a lubricating oil. The servo valve upper shaft 52 is sealed relative to the chamber 54 by a seal 56, and the tool includes a pressure compensator having a balancing piston 58 mounted in part of the oil filled chamber 54. The piston 58, together with the seal 56, prevent ingress of well or drilling fluids to the chamber 54, and thus ensure continued functioning of the servo valve 12. Furthermore, as will be described below, the pressure balancing piston 58 ensures that the oil in the chamber 54 experiences the same pressure as fluid in the drill string 14, which prevents hydraulic lock and facilitates functioning of the servo valve 12.

The tool 10 also includes an inner body 60 mounted within the tool housing 26, and a flow tube 62 which extends from the body 60 within the main valve piston 28. The flow tube 62 defines a first servo valve seat 64 and the inner body 60 a second servo valve seat 66. In the first, de-energised and second, energised closed positions of the servo valve 12, the servo poppet 32 is in abutment with the respective first and second servo valve seats 64 and 66. The servo poppet 32 is biased towards the de-energised sealing position in abutment with the first valve seat 64 by a spring 68 of the actuating assembly 36.

Various sensors (not shown) are provided in a sealed lower portion 70 of the tool, and may include an inclinometer, a device for measuring azimuth, an accelerometer, pressure/temperature sensors, a flowmeter and/or logging sensors for determining the characteristics of surrounding rock formations. Also, appropriate electronic control systems are provided in the portion 70 for recording the measured parameters and controlling movement of the servo valve 12 to generate fluid pressure pulses corresponding to the measured parameter. The portion 70 is sealed, allowing the electronics, sensors and the like to be contained within an atmospheric chamber.

The tool housing 26 is mounted within the drill string 14 by an outer mounting in the form of a stator 72, which includes a shoulder 74 of restricted bore diameter compared to a remainder to the drill string 14, and a ported collar 76 that receives the tool housing 26. The stator 72 and the main valve body 24 together define an external fluid flow channel 84 for flow of drilling fluid through the tool 10.

As noted above, during drilling of the borehole 16, fluid flows through the string 14 in the direction of the arrows A. In the de-energised position of the tool 10 shown in FIG. 1, fluid flowing through the tool string 14 encounters the stator shoulder 74. This, together with the main valve body 24, creates a restriction to flow of the drilling fluid, causing a pressure drop across the stator/valve body. Accordingly, there is a pressure differential between an upstream location 78 and a downstream location 80, the pressure at 78 being higher.

With the poppet valve 32 in the first, de-energised closed position abutting the first valve seat 64, the passage 42 sees the pressure of the drilling fluid at location 78 through the inlets 40 and passage 42. However, the seating of the poppet 32 on the first valve seat 64 blocks any flow through the passage 42. At this time, the reverse side of the servo poppet 32 sees the lower pressure of location 80 through the outlet 44, and this pressure is also transmitted to the oil filled chamber 54 by the balancing piston 58. In this fashion, only the difference in pressures between the pressure at locations 78 and 80 acts across the small area of the servo poppet 32. The force of the spring 68 is then sufficient to hold the servo poppet 32 in the first closed position against the first valve seat 64.

When it is desired to generate a fluid pressure pulse to transmit data concerning a measured parameter to surface, the solenoid is activated to translate the lower shaft 34, moving the servo poppet 32 to the second, energised closed position, in sealing abutment with the second valve seat 66. This allows the pressure at 78 to enter the cylinder 30 through the passageways 46, urging the main valve piston 28 forward and evacuating the fluid in the cylinder 30 above piston face 29 through the ports 48. This movement causes the main valve body 24 to enter the constricted area defined by the stator restriction 74. The result of this movement is to further increase the pressure at 78 and the resulting additional pressure provides the positive pressure change desired, generating a pressure pulse which is detected at surface.

The additional pressure at 78 also provides additional force to urge the piston 28 forward and to hold it at the extreme of its travel shown in FIG. 2. Furthermore, the pressure at 78 has now been transmitted to the oil filled chamber 54 by the balancing piston 58. Accordingly, the force necessary to hold the servo poppet 32 on the second valve seat 66 is only the difference between the pressures 78 and 80 over the small area of the second valve seat 66, plus the restoring force of the spring 68.

The servo poppet 32 moves from the first, primary valve seat 64 to the second, secondary valve seat 66 in a period of milliseconds. During this time, no significant fluid movement takes place between the inlets 40 and the outlet 44. Indeed, the volume of fluid which flows is only that necessary to fill the area behind the piston 28 for the extent of its stroke, and amounts to only some few cubic centimeters.

When the servo poppet 32 is de-energised, it returns to the primary seat 64 and the fluid behind the piston 28 is vented through the passageways 46 and the area 82 around the upper shaft 52 to the outlet 44. At this time, the pressure in this area is restored to the pressure 80 and this pressure is again transmitted by means of the balancing piston 58 to the oil chamber 54 and thus to the actuator assembly 36. The effect of this is to reduce the pressure at 78 as the main valve body 24 is now restored to its relaxed position by virtue of the fluid pressure force exerted on the body 24, and the increased flow restriction at the stator 72 has been removed.

Repeated movements of the main valve body 24 in this fashion allow a coded stream of positive pressure pulses representing various measurements made by the sensors located in the portion 70 to be transmitted to surface.

Various modifications may be made to the foregoing within the scope of the present invention.

For example, the downhole tool may be utilised to generate fluid pressure pulses for any conceivable downhole use and is not limited to use in mud pulse telemetry such as MWD/LWD procedures. Indeed, the tool may be utilised to control actuation of any fluid operated downhole tool or component, such as valves, sliding sleeves, perforating guns, packers, centralisers or the like.

The tool may be functioned in reverse to generate negative pressure pulses.

Alternatively or additionally, movement of the control member from the energised closed position to the de-energised closed position may be adapted to generate a fluid pressure pulse.

The flow paths may extend between part of the flow restrictor and a source of actuating fluid. Accordingly, the tool may be actuatable using a dedicated control fluid, such as a hydraulic fluid, and the tool may further comprise control lines, supply conduits or the like for coupling the tool to a source of control fluid.

The tool may be arranged to generate a negative fluid pressure pulse (a decrease in fluid pressure detected at surface) by movement of said part from the energised to the de-energised position.

The actuating assembly may be mechanical, electronic or fluid operated. The actuating assembly may comprise a motor or the like adapted to exert a drive force on the control member, which may be coupled to the motor through a drive rod, shaft, screw or the like. Alternatively, where the actuating assembly is fluid operated, the assembly may comprise a piston. Thus by controlling fluid supply to the piston, movement of the actuating member can be controlled.

The tool may further comprise an intermediate member and the first fluid flow path may be for fluid flow to the intermediate member and the second fluid flow path for fluid flow from the intermediate member. Thus the control member may serve for controlling fluid flow to and from the intermediate member, which may in turn control actuation of the flow restrictor, for example, by fluid communication with the flow restrictor. This may allow isolation of at least part of the flow restrictor from the actuating fluid and said part may therefore be actuatable, for example, using a dedicated control fluid such as a hydraulic fluid. The intermediate member may comprise a piston mounted in a cylinder.

We claim:

1. A downhole tool for generating a fluid pressure pulse, the tool comprising:

a fluid actuated flow restrictor;

a first fluid flow path for flow of actuating fluid to actuate the flow restrictor;

a second fluid flow path for flow of actuating fluid to actuate the flow restrictor;

a control member movable between a first closed position where the first fluid flow path is closed and the second fluid flow path is open, and a discrete second closed position where the first fluid flow path is open and the second fluid flow path is closed, for controlling actuation of the flow restrictor; and an intermediate member in fluid communication with the flow restrictor, wherein the first fluid flow path is for fluid flow to the intermediate member and the second fluid flow path is for fluid flow from the intermediate member, the control member serving for controlling fluid flow to and from the intermediate member, which in turn controls actuation of the flow restrictor, wherein the intermediate member comprises a piston mounted in a cylinder.

2. A tool as claimed in claim 1, wherein the tool is adapted to generate fluid pressure pulses to transmit data concerning measured downhole parameters to surface.

3. A tool as claimed in claim 1, wherein the first fluid flow path is for flow of actuating fluid to the flow restrictor and the second fluid flow path is for flow of actuating fluid from the flow restrictor.

4. A tool as claimed in claim 3, wherein the control member serves for controlling flow of actuating fluid to directly actuate the flow restrictor.

5. A tool as claimed in claim 1, wherein at least part of the flow restrictor is isolated from the actuating fluid and is actuatable using a dedicated control fluid.

6. A tool as claimed in claim 1, wherein, during movement of the control member between the first and second closed positions, both the first and second fluid flow paths are open.

7. A tool as claimed in claim 1, wherein the control member is adapted to be moved between said closed positions in a determined time period.

8. A tool as claimed in claim 7, wherein the control member is adapted to be moved between said closed positions in a fraction of a second.

9. A tool as claimed in claim 1, wherein the tool is arranged to allow flow of a determined volume of fluid to or from the flow restrictor through the first and second flow paths.

10. A tool as claimed in claim 9, wherein the flow restrictor comprises a fluid actuated member mounted in a cylinder, and wherein the control member is adapted to control supply of fluid to and from the cylinder to allow said flow of fluid.

11. A tool as claimed in claim 1, wherein the first and second fluid flow paths are dead-ended, such that there is a limited fluid flow through or past the control member, in use.

12. A tool as claimed in claim 1, wherein the control member is movable in response to an applied actuating force.

13. A tool as claimed in claim 1, wherein the tool is arranged such that: when the control member is in the first closed position, part of the flow restrictor is exposed to fluid at a downstream fluid pressure, and when the control member is in the second closed position, said part of the flow restrictor is exposed to fluid at an upstream fluid pressure.

14. A tool as claimed in claim 1, wherein the first closed position of the control member is a de-energised closed position, and the second closed position is an energised closed position.

15. A tool as claimed in claim 14, wherein movement of the control member from the de-energised closed position to the energised closed position is adapted to generate a fluid pressure pulse.

16. A tool as claimed in claim 14, wherein movement of the control member from the energised closed position to the de-energised closed position is adapted to generate a fluid pressure pulse.

17. A tool as claimed in claim 1, wherein the control member is biased towards a selected closed position.

18. A tool as claimed in claim 1, wherein the control member takes the form of a control valve, and wherein the tool comprises a control valve seat, the control valve adapted to sealingly engage said valve seat when in a selected closed position.

19. A tool as claimed in claim 18, comprising a plurality of valve seats, one corresponding to each of said first and second closed positions of the control valve.

20. A tool as claimed in claim 1, wherein the first and second fluid flow paths are internal and defined by a body of the tool.

21. A tool as claimed in claim 1, wherein the flow paths extend between part of the flow restrictor and an exterior of the tool, and wherein the tool is actuatable using down hole fluid.

22. A tool as claimed in claim 1, wherein the flow paths extend between part of the flow restrictor and a source of actuating fluid.

23. A tool as claimed in claim 22, wherein the tool is actuatable using a dedicated control fluid, and wherein the tool comprises control lines for coupling the tool to a source of control fluid.

24. A tool as claimed in claim 1, wherein one of the first and second fluid flow paths comprises an inlet and the other one of said fluid flow paths comprises an outlet, facilitating selective fluid flow to and from part of the flow restrictor.

25. A tool as claimed in claim 24, wherein the first fluid flow path forms the inlet and the second fluid flow path forms the outlet, facilitating fluid flow from the inlet to the flow restrictor through the first fluid flow path, and from the flow restrictor to the outlet through the second fluid flow path.

26. A tool as claimed in claim 1, wherein at least part of the flow restrictor is movable to generate a fluid pressure pulse, and wherein said part is moveable between a de-energised position and an energised position where fluid flow is restricted compared to the de-energised position.

27. A tool as claimed in claim 26, wherein the tool is arranged to generate a positive fluid pressure pulse by movement of said part of the flow restrictor from the de-energised to the energised position.

28. A tool as claimed in claim 26, wherein the tool is arranged to generate a negative fluid pressure pulse by movement of said part of the flow restrictor from the energised to the de-energised position.

29. A tool as claimed in claim 1, wherein the control member is repeatedly movable between the first and second closed positions, for generating a plurality of fluid pressure pulses.

30. A tool as claimed in claim 1, wherein the tool takes the form of a measurement whilst drilling (MWD) or logging whilst drilling (LWD) tool comprising at least one sensor for measuring at least one downhole parameter.

31. A downhole tool for generating a fluid pressure pulse, the tool comprising:

a fluid actuated flow restrictor, wherein the flow restrictor takes the form of a main valve, and wherein a body of the main valve is moveable between de-energised and energised positions, to generate a fluid pressure pulse, wherein the flow restrictor comprises a piston mounted in a cylinder, the control member being adapted to control supply of fluid to and from the cylinder to allow said flow of fluid;

a first fluid flow path for flow of actuating fluid to actuate the flow restrictor;

a second fluid flow path for flow of actuating fluid to actuate the flow restrictor;

a control member movable between a first closed position where the first fluid flow path is closed and the second fluid flow path is open, and a discrete second closed position where the first fluid flow path is open and the second fluid flow path is closed, for controlling actuation of the flow restrictor.

32. A tool as claimed in claim 31, wherein the piston is coupled to the valve body, and is movable to thereby move the valve body and generate a pulse.

33. A tool as claimed in claim 31, wherein the piston is movable on selective exposure to fluid pressure, controlled by the control member.

34. A tool as claimed in claim 31, wherein the piston comprises a piston face, and wherein when the control member is in the first closed position, said piston face is exposed to fluid at a downstream fluid pressure, and when the control member is in the second closed position, said piston face is exposed to fluid at an upstream fluid pressure.

35. A downhole tool for generating a fluid pressure pulse, the tool comprising:

a fluid actuated flow restrictor;

a first fluid flow path for flow of actuating fluid to actuate the flow restrictor;

a second fluid flow path for flow of actuating fluid to actuate the flow restrictor;

a control member movable between a first closed position where the first fluid flow path is closed and the second fluid flow path is open, and a discrete second closed position where the first fluid flow path is open and the second fluid flow path is closed, for controlling actuation of the flow restrictor, wherein the control member forms part of an actuating assembly, and wherein a further part of the actuating assembly serves for moving the control member between said closed positions.

36. A tool as claimed in claim 35, wherein the actuating assembly is electro-mechanical.

37. A tool as claimed in claim 36, wherein the actuating assembly comprises a solenoid having a solenoid rod and a solenoid coil for exerting an actuating force on the rod, and wherein the control member is coupled to the solenoid rod.

38. A tool as claimed in claim 35, wherein the actuating assembly comprises a motor adapted to exert a drive force on the control member, and wherein the control member is coupled to the motor through a drive rod.

39. A tool as claimed in claim 35, wherein the actuating assembly is fluid operated.

40. A tool as claimed in claim 39, wherein the actuating assembly comprises an actuating piston for controlling movement of the control member by control of fluid supply to the actuating piston.

41. A downhole tool for generating a fluid pressure pulse, the tool comprising:

a fluid actuated flow restrictor;

a first fluid flow path for flow of actuating fluid to actuate the flow restrictor;

a second fluid flow path for flow of actuating fluid to actuate the flow restrictor;

a control member movable between a first closed position where the first fluid flow path is closed and the second fluid flow path is open, and a discrete second closed position where the first fluid flow path is open and the second fluid flow path is closed, for controlling actuation of the flow restrictor;

an outer mounting which, together with the flow restrictor, defines an external fluid flow channel; and a tool body housing the flow restrictor and the control member, and wherein the tool body is adapted to be mounted in the outer mounting.

42. A tool as claimed in claim 41, wherein the flow restrictor is movable relative to the outer mounting to restrict the external fluid flow channel and generate a fluid pressure pulse.

43. A tool as claimed in claim 41, wherein the outer mounting is adapted to locate the tool downhole.

44. A downhole tool for generating a fluid pressure pulse, the tool comprising:

a fluid actuated flow restrictor;

a first fluid flow path for flow of actuating fluid to actuate the flow restrictor;

a second fluid flow path for flow of actuating fluid to actuate the flow restrictor;

a control member movable between a first closed position where the first fluid flow path is closed and the second fluid flow path is open, and a discrete second closed position where the first fluid flow path is open and the second fluid flow path is closed, for controlling actuation of the flow restrictor, wherein at least part of the control member is mounted in a chamber isolated from external fluid, and wherein a lubricating fluid is provided in the chamber, and wherein the tool includes a pressure compensator for pressurising the lubricating fluid to a pressure of fluid in the borehole.

* * * * *